US005548628A

United States Patent [19]

Eggleston et al.

[11] Patent Number: 5,548,628

[45] **Date of Patent: *Aug. 20, 1996**

[54] TARGET/ROTOR CONNECTION FOR USE IN X-RAY TUBE ROTATING ANODE ASSEMBLIES

[75] Inventors: Michael R. Eggleston, Scotia; Mark G. Benz, Burnt Hills; Melvin R. Jackson, Niskayuna; Robert J. Zabala, Schenectady, all of N.Y.

[73] Assignee: General Electric Company, Schenectady, N.Y.

[ * ] Notice: The term of this patent shall not extend beyond the expiration date of Pat. No. 5,498,187.

[21] Appl. No.: 321,024

[22] Filed: Oct. 6, 1994

[51] Int. Cl.[6] ..... H01J 35/10

[52] U.S. Cl. ..... 378/125; 378/128; 378/131

[58] Field of Search ..... 378/125, 119, 378/121, 127, 128, 129, 130, 131, 135, 141, 143, 144

[56] References Cited

U.S. PATENT DOCUMENTS

| | | | |
|---|---|---|---|
| 3,710,162 | 1/1973 | Bougle | 378/144 X |
| 3,828,217 | 8/1974 | Ebersberger | 378/128 |
| 4,063,124 | 12/1977 | Appelt | 378/128 |
| 4,097,759 | 6/1978 | Furbee et al. | 378/144 X |
| 4,144,471 | 3/1979 | Hartl | 378/129 X |
| 4,187,442 | 2/1980 | Hueschen et al. | 378/129 X |
| 4,335,327 | 6/1982 | Waugh et al. | 378/129 |
| 4,393,511 | 7/1983 | Jens | 378/128 |
| 4,736,400 | 4/1988 | Koller et al. | 378/144 X |

FOREIGN PATENT DOCUMENTS

| | | | |
|---|---|---|---|
| 0125991 | 9/1979 | Japan | 378/128 |
| 57-55041 | 4/1982 | Japan | 378/144 |
| 58-216349 | 12/1983 | Japan | 378/125 |

*Primary Examiner*—David P. Porta

*Attorney, Agent, or Firm*—R. Thomas Payne; William H. Pittman

[57] ABSTRACT

An improved high performance x-ray system having a rotating anode therein which includes an improved target/stem assembly comprising a metallic target and a large bore, thin-walled tubular metal stem which, when connected to a rotor body assembly, provides a rotating x-ray tube anode assembly is disclosed. An insert of an alloy, for example, tantalum alloy, is placed between the target layer and the large bore, thin-walled tubular stem and then bonded thereto to produce a composite x-ray tube target/stem assembly. The target/stem assembly is then connected to a rotor body assembly by fasteners, preferably threaded, applied through a plate connected to the tubular stem and preferably through a thermal washer to produce a rotating anode assembly having high bond strength that provides acceptable balance during x-ray tube operations.

32 Claims, 7 Drawing Sheets

TARGET/ROTOR CONNECTION FOR USE IN X-RAY TUBE ROTATING ANODE ASSEMBLIES

RELATED APPLICATIONS

This application is related to commonly assigned U.S. patent application Ser. No. 08/272,063 (RD-22,771) of Benz et al., filed Jul. 8, 1994, U.S. patent application Ser. No. 08/272,065 (RD-23,773) of Eggleston et al., filed, Jul. 8, 1994, and U.S. patent application Ser. No. 08/272,064 (RD-23,774) of Eggleston et al., filed Jul. 8, 1994, U.S. patent application Ser. No. 08/317,609, filed Oct. 6, 1994 (RD-22,936), of Benz et al., U.S. patent application Ser. No. 08/321,022, filed Oct. 6, 1994 (RD-23,850) of Benz et al., and U.S. patent application Ser. No. 08/321,837, filed Oct. 6, 1994 (RD-23,949) of Benz et al., filed currently herewith, the disclosure of each is hereby incorporated by reference.

BACKGROUND OF THE INVENTION

The present invention relates to equipment for diagnostic and therapeutic radiology and, more particularly, to high performance targets used in x-ray generating equipment, such as computerized axial tomography (C.A.T.) scanners. More particularly, the invention is directed to high performance rotating x-ray tube anode structures having a large bore tubular stem. Most particularly, it relates to the joining of the target disk, preferably made of a molybdenum-alloy, to the tubular stem, preferably a large bore, thin-walled stem and preferably made of a niobium alloy, and the attachment of the target/stem assembly combination to the rotor body assembly.

X-rays are produced when, in a vacuum, electrons are released, accelerated and then abruptly stopped. This takes place in the x-ray tube. To release electrons, the filament in the tube is heated to incandescence (white heat) by passing an electric current through it. The electrons are accelerated by a high voltage (ranging from about ten thousand to in excess of hundreds of thousands of volts) between the anode (positive) and the cathode (negative) and impinge on the anode, whereby they are abruptly slowed down. The anode, usually referred to as the target, is often of the rotating disc type so that the electron beam is constantly striking a different point on the target perimeter. The x-ray tube itself is made of glass and contains a cathode plate, an anode assembly including a rotating disk target and a rotor that is part of a motor assembly that spins the target A stator is provided outside the x-ray tube proximate to the rotor and overlapping therewith about two-thirds of the rotor length. The glass x-ray tube is enclosed in a protective casing having a window for the x-rays that are generated to escape the tube. The casing is filled with oil to absorb the heat produced by the x-rays. The casing in some x-ray tubes may include an expansion vessel, such as a bellows. High voltages for operating the tube are supplied by a transformer. The alternating current is rectified by means of rectifier tubes (or "valves") in some cases by means of barrier-layered rectifiers.

For therapeutic purposes—e.g., the treatment of tumors, etc.—the x-rays employed are in some cases generated at much higher voltages (over 4,000,000 volts). Also, the rays emitted by radium and artificial radiotropics, as well as electrons, neutrons and other high speed particles (for instance produced by a betatron), are used in radio therapy.

X-ray tube performance can be affected by the balance of the anode assembly which includes the target, the stem and the rotor. Specifically, during x-ray tube manufacturing, it is important to be able to balance the anode assembly and have it stay balanced during completion of the manufacturing cycle and during operation of the x-ray tube. As the size of x-ray tube targets has increased to six and one half inch (6½") and beyond, it has proved difficult to maintain this balance and thus, reduced manufacturing yields and shortened operational lives have been experienced. Field evaluation of failed x-ray tubes has indicated that the imbalance of the anode assembly has occurred in the region of the attachment of the target/stem or shaft assembly to the rotor body assembly.

In producing new and improved targets for rotary anode x-ray application, it is not only necessary for the target/stem connection to survive a more rigorous environment in the x-ray tube but it must also be able to survive more rigorous manufacturing processes such as the vacuum firing at temperatures up to about 1500 degree (s) C. This requires that the target/stem connection provide the following benefits:

1. The bonding temperature be low enough to not adversely affect the properties of the TZM alloy which can lose significant strength at about 2000 degree(s) C.

2. After bonding, have sufficient high temperature strength to support the bond through the additional manufacturing steps such as vacuum firing to about 1500 degree(s) C.

3. The bond should be strong and should not be degraded by thermal excursions during normal x-ray tube operation up to 1500 degree(s) C. for extended periods of time.

For a particular set of bonding metals, such as in diffusion bonding, to work under the above parameters, it must have certain inherent properties. The first would be that the metals do not have a eutectic or peritectic reaction with the TZM target layer. Ultimately, the bond metals used, such as in diffusion bonding, should form only a simple binary solid solution with the molybdenum in the TZM alloy.

A basic rule in bonding dissimilar materials is that for a bond to occur there must be some intermixing of the elements between the two materials. Also, for this bond to have significant strength, the gradation of intermixing should approximate that of a binary diffusion couple where the two materials diffuse together in equal portions.

Conventional target/stem connections, to the extent they may be viable in conventional x-ray imaging systems, face a much more severe test in connection with the use of graphite members in x-ray tubes used in medical computerized axial tomography (C.A.T.) scanners. For the formation of images, a medical C.A.T. scanner typically requires an x-ray beam of about 2 to 8 seconds duration. Such exposure times are much longer than the fractions-of-a-second exposure times typical for conventional x-ray imaging systems. As a result of these increased exposure times, a much larger amount of heat (generated as a by-product of the process of x-ray generation in the target region) must be stored and eventually dissipated by the rotating anode.

Recently, the problem related to anode assembly failure due to imbalance reached a critical point. Due to the tremendous stresses undergone by the larger diameter x-ray tubes during continuous operation, the average tube life had been approximately 30,000 scan-seconds, utilizing the conventional threaded stem, Belleville washer mechanical connection. Since a majority of the failures were related to anode assembly imbalance, the need for an improved anode assembly and especially a more durable target/stem—rotor body assembly connection that would eliminate the imbalance while maintaining the effectiveness of the target became apparent. Such a target/stem assembly—rotor body assembly connection desirably would provide sufficient balance during the operation life of the target while reducing significantly, if not eliminating, entirely failures due to anode assembly imbalance.

SUMMARY OF THE INVENTION

In carrying out the present invention in preferred forms thereof, we provide an improved x-ray anode assembly for use in x-ray tubes, such as those incorporated in diagnostic and therapeutic radiology machines, for example, computer tomography scanners. Illustrated embodiments of the invention disclosed herein, are in the form of x-ray systems having an x-ray tube which includes the improved anode assembly and specifically a more durable connection between the target/stem assembly, which includes a large bore, thin-walled, tubular stem, and the rotor body assembly.

One specific embodiment of the present invention includes an x-ray tube comprising: a glass envelope; a cathode assembly, operatively positioned in the glass envelope; an anode assembly including: a rotor body assembly including a rotor and a stator, the stator being operatively positioned relative to the rotor body assembly; and a target, operatively positioned relative to the cathode assembly, operatively connected to a large bore, thin-walled tubular stem to form a target/stem assembly, and means, operatively positioned between the target/stem assembly and the rotor body assembly, for operatively connecting the target/stem assembly to the rotor body assembly such that the target/stem assembly connection to the rotor body assembly has sufficient resistance to structural changes during severe protocol uses to retain proper anode assembly balance.

Another aspect of the present invention is embodied in an x-ray system comprising: an enclosure having oil contained therein; an oil pump, operatively positioned relative to the enclosure for circulating oil within the system; at least one cooling means, operatively connected to the enclosure and the oil pump, for cooling the oil; an x-ray tube, operatively positioned inside the enclosure, for generating and directing x-rays toward a target, the x-ray tube comprising: a glass envelope; a cathode, operatively positioned in the glass envelope; an anode assembly including: a rotor body assembly including a rotor and a stator, the stator being operatively positioned relative to the rotor body assembly; and a target, operatively positioned relative to the cathode assembly, operatively connected to a large bore, thin-walled tubular stem to form a target/stem assembly, and means, operatively positioned between the target/stem assembly and the rotor body assembly, for operatively connecting the target/stem assembly to the rotor body assembly such that the target/stem assembly connection to the rotor body assembly has sufficient resistance to structural changes during severe protocol uses to retain proper anode assembly balance.

Another aspect of the present invention includes an anode assembly for an x-ray tube comprising: a rotor body assembly including a rotor and a stator, the stator being operatively positioned relative to the rotor body assembly; and a target, operatively positioned relative to the cathode assembly, operatively connected to a large bore, thin-walled tubular stem to form a target/stem assembly, and means, operatively positioned between the target/stem assembly and the rotor body assembly, for operatively connecting the target/stem assembly to the rotor body assembly such that the target/stem assembly connection to the rotor body assembly has sufficient resistance to structural changes during severe protocol uses to retain proper anode assembly balance.

Among the advantages of a thin-walled, large-bore target/stem assembly are: 1) The strength and stiffness of the resulting target/stem assembly in bending and torsion are significantly improved over a small-diameter target/stem assembly. 2) The tensile properties of the resulting target/stem assembly are nearly the same as a small-diameter target/stem assembly. 3) The same thermal resistance offered by the small-diameter target/stem assembly can be obtained by controlling the wall thickness of the large-bore target/stem assembly. 4) However, calculations have indicated that the thinness of the wall is limited by: 1. Buckling behavior under torsion and other loading. 2. Strength/stiffness of the stem in tension. 3. Ability to obtain, manufacture and work with a thin-walled shaft.

Accordingly, an object of the present invention is to provide an x-ray system including an improved x-ray tube having increased scan life.

Another object of the present invention is to provide an x-ray tube having an improved anode assembly which maintains proper balance during the life of the tube.

A further object of the present invention is to provide a target/stem assembly—rotor body assembly attachment configuration having fewer parts.

A further object of the present invention is to provide a target/stem assembly—rotor body assembly connection which simplifies the manufacture of the x-ray tube anode assembly.

Other objects and advantages of the invention will be apparent from the following description, the accompanying drawings and the appended claims.

DESCRIPTION OF THE PREFERRED EMBODIMENT

Figure 1A:
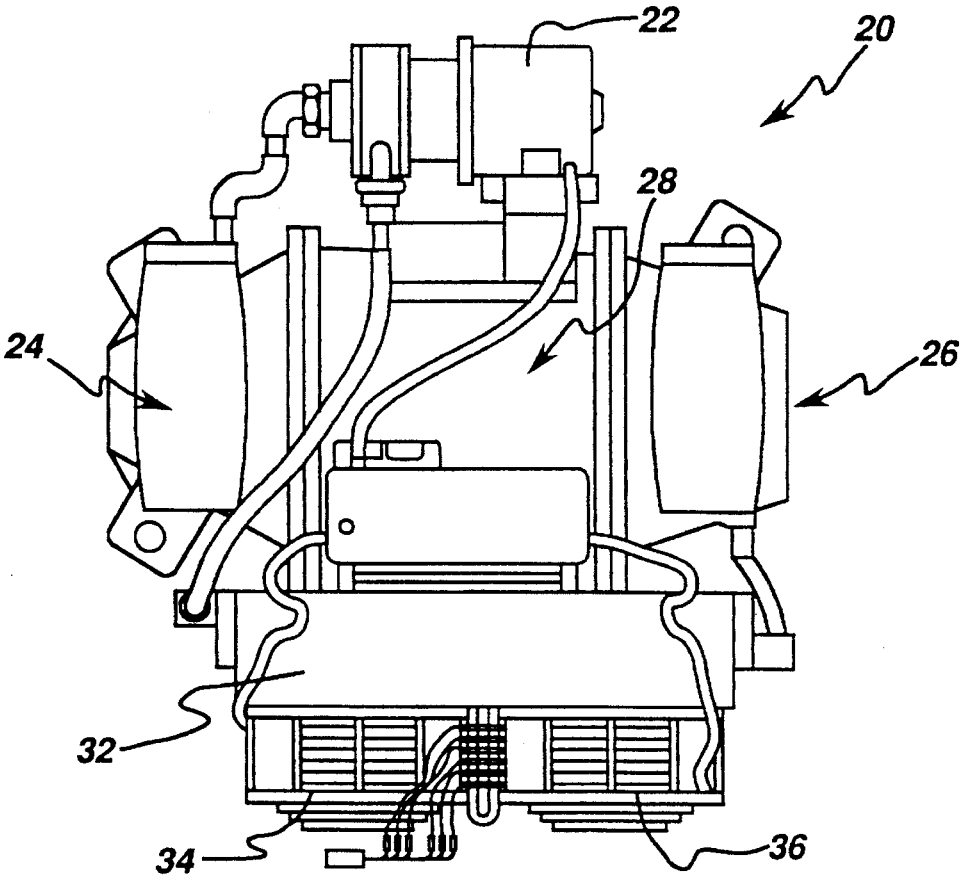
fig. 1a PRIOR ART
FIG. 1*a* is a plan view of a representative x-ray system.
Figure 1B:
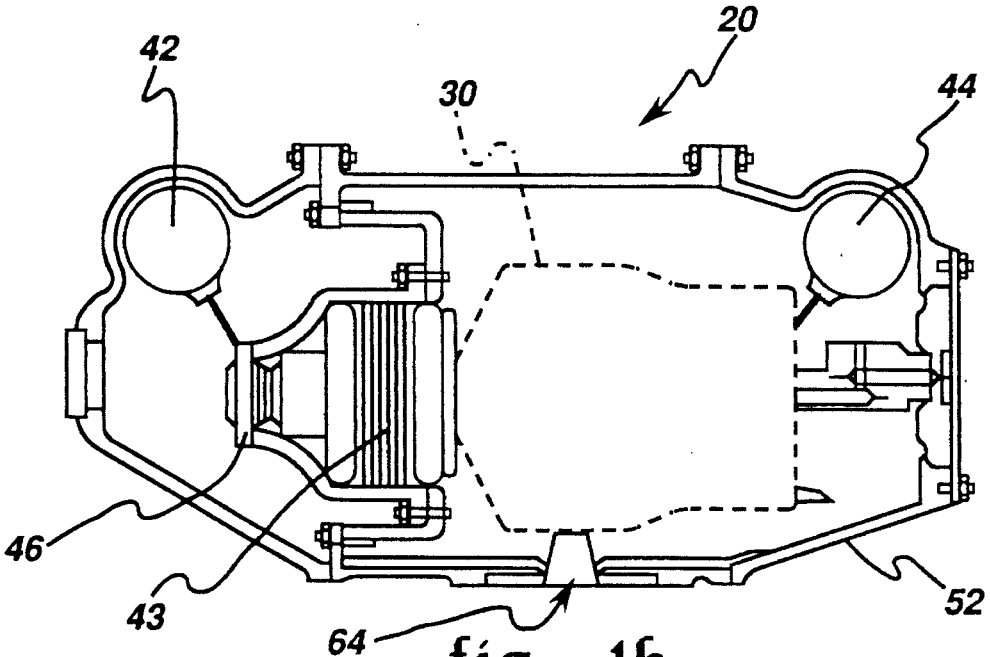
fig. 1b PRIOR ART
FIG. 1*b* is a sectional view with parts removed of the x-ray system of FIG. 1*a;*
Figure 2:
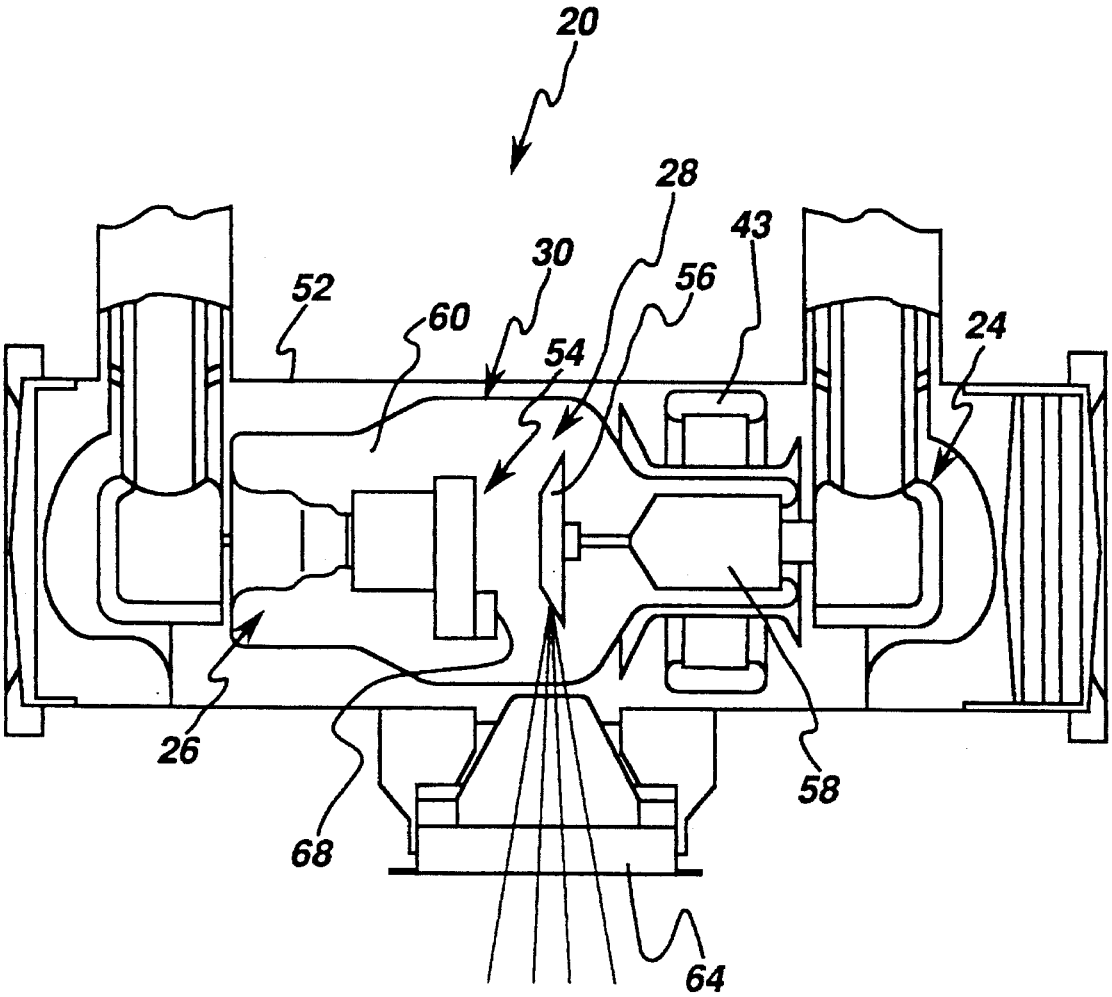
fig. 2 PRIOR ART
FIG. 2 is a schematic representation of another representative x-ray system having an x-ray tube positioned therein.

A representative x-ray system with which the present invention could be used is illustrated as generally designated by the numeral 20 in FIGS. 1*a*, 1*b* and 2. As can be seen, the system 20 comprises an oil pump 22, an anode end 24, a cathode end 26, a center section 28 positioned between the anode end and the cathode end, which contains the x-ray tube 30. A radiator 32 for cooling the oil is positioned to one side of the center section and may have fans 34, 36 operatively connected to the radiator 32 for providing cooling air flow over the radiator as the hot oil circulates therethrough. The oil pump 22 is provided for circulating the hot oil through the system 20 and through the radiator 32, etc. As shown in FIG. 1*b*, electrical connections are provided in the anode receptacle 42 and the cathode receptacle 44.

As shown in FIG. 2, the x-ray system 20 comprises a casing 52, preferably made of aluminum and lined with lead, a cathode plate 54, a rotating target 56 and a rotor 58 enclosed in a glass envelope 60. A stator 43 is positioned outside the glass envelope 60 inside the lead lined casing 52 relative to the rotor 58. The casing 52 is filled with oil for cooling and high voltage insulation purposes as was explained above. A window 64 for emitting x-rays is operatively formed in the casing 52 and relative to the target 56 for allowing generated x-rays to exit the x-ray system 20.

Figure 3:
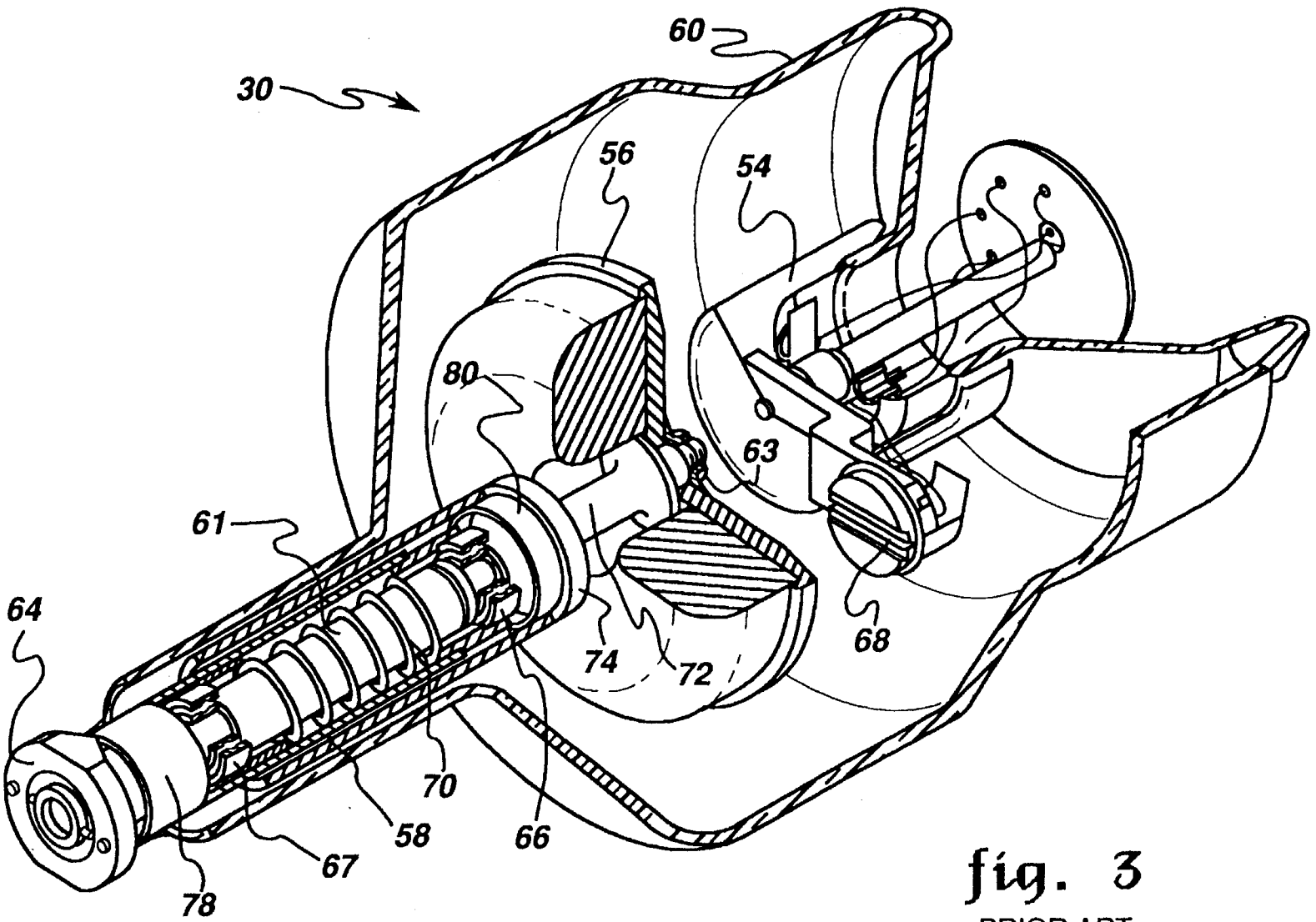
fig. 3 PRIOR ART
FIG. 3 is a partial perspective view of a representative x-ray tube with parts removed, parts in section, and parts broken away.

Referring to FIG. 3, there is shown the cathode 54 positioned inside the glass envelope 60. As is well known, inside the glass envelope there is a vacuum of about $10^{-5}$ to about $10^{-9}$ torr. The electricity generates x-rays that are aimed from the cathode filament 68 to the top of the target 56. The target is conventionally connected to a rotating shaft 61 at one end by a Belleville nut 63 and by another nut at the other end 64. A front bearing 66 and a rear bearing 67 are operatively positioned on the shaft 61 and are held in position in a conventional manner. The bearings 66 and 67 are usually lubricated and are susceptible to failure at high operating temperatures.

A preload spring 70 is positioned about the shaft 61 between the bearings 66, 67 for maintaining load on the bearings during expansion and contraction of the anode assembly. A rotor stem/stud 72 is utilized to space the end of the rotor most proximate the target 56 from the rotor hub 74. The bearings, both front 66 and rear 67, are held in place by bearing retainers 78 and 80. The rotor body assembly also includes a stem ring and a stem, all of which help to provide for the rotation of the rotor 58 with the target 56.

The temperature in the area of the filament 68 can get as high as about 2500° C. Other temperatures include about 1100° C. near the center of the rotating target 56, which rotates at about 10,000 rpm. Temperatures of the focal spot on the target 56 can approximate 3200° C. and temperatures on the outside edge of the rotating target 56 approach about 1300° C. The temperature in the area of the rotor hub 74 approaches 700° C. and of the front bearing approaches 450° C. maximum. Obviously, as one moves from the target 56 to the rotor 58 and stator 43, the temperature appears to decrease.

During operation of some x-ray systems having larger diameter targets, severe protocol users have maximized usage of the system by making as many scans at high peak power in as short a time as possible. One of the problems with utilizing any x-ray system in this continuous type of operation is the amount of heat that is generated, which may in fact destroy the bearings 66, 67, especially the front bearing 66.

If the x-ray tube target 56 and rotor 58 were allowed to continue to rotate at 10,000 rpm between scans, the bearings would wear out prematurely and cause the tube to fail. Thus, if it appears that there would to be more than 60 seconds between scans, the x-ray system operating control system software is programmed to brake the rotor by rapidly slowing it completely down to zero (0) rpm. However, when ready to initiate a scan, the control system software is programmed to return the target and the rotor to 10,000 rpm as quickly as possible. These rapid accelerations and brakes are utilized because, among other reasons, there are a number of resonant frequencies that must be avoided during the acceleration from zero (0) to 10,000 rpm and the brake from 10,000 rpm to zero (0) rpm. In order to pass through these resonant frequencies both immediately before a scan or a series of scans and after a scan or series of scans as fast as possible, the x-ray system applies maximum power to bring the target, or anode assembly, to 10,000 rpm or down to zero (0) rpm in the least amount of time possible.

It should be noted that the x-ray tube target and rotor can be accelerated to 10,000 rpm from a dead stop in about 12 to about 15 seconds and slowed down at about the same rate. Vibration from the resonant frequencies is a problem, if the tube is allowed to spin to a stop without braking.

It has been found that during these rapid accelerations to 10,000 rpm and the immediate braking from 10,000 rpm to zero, stresses, mechanical as well as thermal, impact on the rotor 58 and the target/stem-rotor connection. These stresses may contribute to anode assembly imbalance which is believed to be the leading cause of failure of the recent x-ray tube failures. It has been determined that these imbalance problems are most likely caused by changes that occur in the area of the target 72/stem assembly—rotor 58 body assembly attachment/connection.

Figure 4:
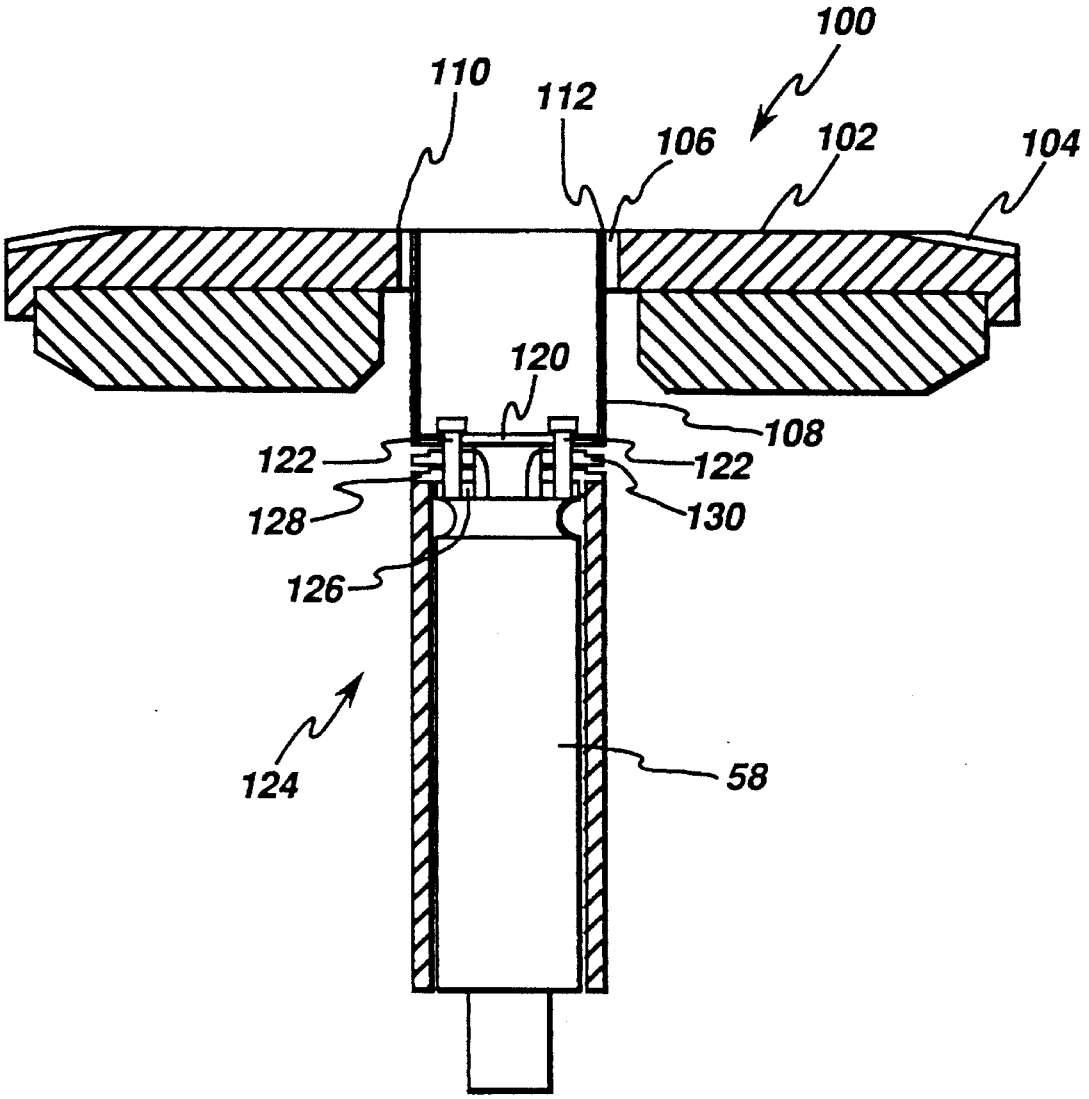
FIG. 4 is a sectional view of one embodiment of an x-ray tube target/stem connection of the present invention.

Referring now to FIG. 4, therein is shown a representative target/stem assembly connected to the rotor body assembly embodying the present invention, in one preferred form thereof, generally designated by the reference numeral 100. The target/stem assembly 100 comprises the target 102, preferably made of molybdenum alloy TZM, and, a focal track 104, preferably made of a tungsten-rhenium alloy, operatively connected to the target by conventional metallurgical means for reflecting the x-rays generated by the cathode 68 through the window 64 (as shown in FIG. 2). A ductile insert 106 for bonding, such as diffusion bonding, to the tubular stem member 108 may be co-processed with the target 102 during the manufacture thereof. The target/stem assembly is a powder-metallurgy-alloy preferably compatible with all processes used for target manufacture including: powder making, die pressing, sintering, forging, annealing, and coating or brazing to a graphite back (not shown). The insert 106 alloy should also be able to maintain a small grain size, high strength and good ductility during the combination of process steps utilized during the manufacture of the target which includes the insert being operatively connected to the internal portion of the target along seam 110. One such material is tantalum. The insert 106 could also be selected from a group of tantalum-alloys comprising: Ta-10 W (Ta,10 W); T-111 (Ta,8 W, 2 Hf); T-222 (Ta, 9.6 W, 2.4 Hf, 0.01 C); ASTAR-811 C (Ta, 8 W, 1Re, 1 Hf, 0.025 C); GE-473 (Ta, 7 W, 3 Re); Ta-2.5 W (Ta, 2.5 W); and Ta-130 (Ta with 50–200 ppm Y) or other metals which meet the above criteria and which can maintain the bond between the stem and the target for at least about 40,000 scan seconds.

The tubular stem 108 is preferably made of niobium and more preferably from a niobium-based alloy chosen from the group comprising: CB-752 (Nb, 10 W, 2.5 Zr); C129Y (Nb, 10 W, 10 Hf, 0.1 Y); FS-85 (Nb,28 Ta, 11 W, 0.8 Zr); C103 (Nb,10,Hf, 1 Ti, 0.7 Zr), of which C103 is most preferred, or other metals which can maintain the bond between the tubular stem 108 and the target 102 for at least about 40,000 scan seconds when used as described above.

The tubular stem portion 112 which makes contact with the insert 106 can be slightly tapered as can be the insert 106.

This tapering is to facilitate press fitting the tubular stem 108 into the insert 106 so that sufficient pressure between the two for diffusion bonding is provided. The tubular stem member reduces the conduction of heat down the stem to the rotor and bearings.

One advantage of the materials for both the stem and the insert mentioned above is that the coefficient of thermal expansion of the stem material is greater than the coefficient of thermal expansion of the insert material which is in turn greater than the coefficient of thermal expansion of the target material. In order to achieve effective diffusion bonding between all three components, intimate contact between adjacent components at the temperature for diffusion bonding is required. The differences in the coefficients of thermal expansion stated above at diffusion bonding temperatures result in a compressive pressure between the components (tubular stem, insert and target) thereby ensuring the necessary intimate contact.

There are a variety of methods for attaching the thin-walled stem to the x-ray target. One method investigated uses diffusion bonding and ductile-metal welding and is not dependent on brazes or mechanical fasteners.

One key to this method's success is the incorporation of the ductile insert 106 into the target. This insert serves as a transition layer between the TZM target and the stem. This transition layer allows the stem to be easily attached to the target-insert. This insert has been successfully attached during the forging of the x-ray target; it might also be possible to add the insert during the sintering of the target. In general, only a few additional machining operations and some slight changes in process methods are required. The insert is essentially bonded to the target through the current target fabrication process.

Once the bimetal target is made, the stem needs to be attached. In one method, the stem is welded to the insert after the graphite braze cycle. The use of these ductile alloys avoids the possibility of manufacturing cracks which could grow during service and affect the life of the x-ray tube being created during the welding processes. Tests have also shown that diffusion bonding between the stem and insert can create a solid bond which is as strong as the base metals.

Figure 5:
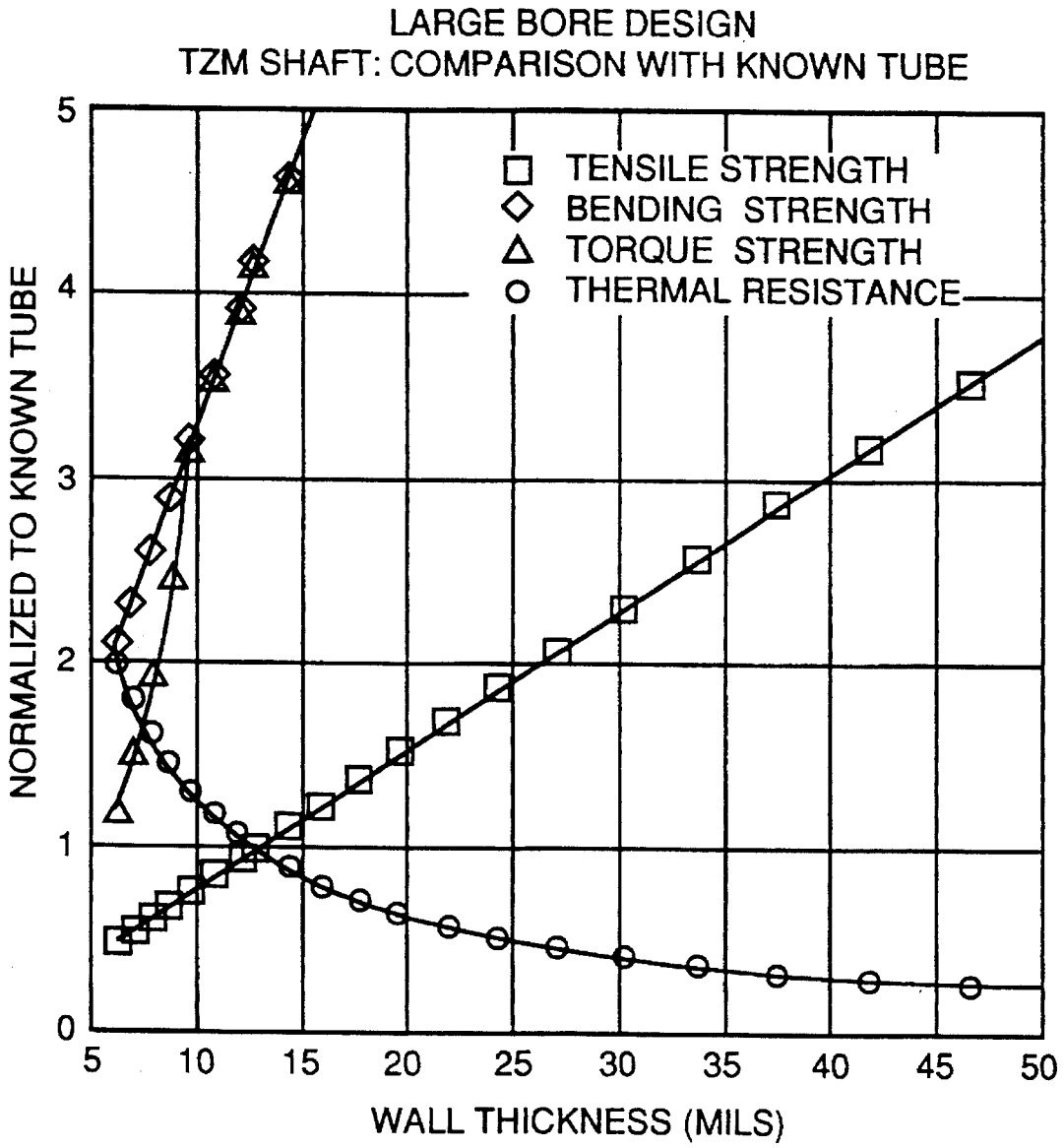
FIG. 5 is a graph illustrating the requirements for stem wall thickness for a large bore tubular stem made of TZM.

Calculations to estimate the requirements for stem wall thickness of a large bore, thin-walled tubular stem have been performed. In the calculations, the properties used for TZM at 1100° C. were approximated from reference data. The outer diameter of the tubular stem was assumed to be 1.5 inches. FIG. 5 plots these calculations for various wall thicknesses for TZM tubular stem material. All of the calculations were normalized against similar calculations for a known x-ray tube stem (OD=0.438"; wall thickness=0.050").

The large bore, thin-walled stem appears to provide much more strength/stiffness in bending and torsion than the known tube geometry. For small wall thicknesses, buckling is sometimes predicted (e.g., for torsion below 10 mils). The thermal resistance of the large bore, thin-walled stem decreases with increasing wall thickness. At about 13 mils, the large bore, thin wall TZM stem offers the same thermal resistance as the known tube stud. For wall thicknesses greater than 13 mils, the tensile strength of the TZM stem increases, but the thermal resistance of the stem decreases.

Discussions with TZM tube vendors have indicated that the minimum possible wall thickness is 25 to 30 mils because tube cracking or warpage would most likely result during the manufacture of a tube having a wall thinner than 25 mils.

In summary, the calculations have shown that for a large bore, TZM thin-walled stem: 1) A shaft tensile strength equivalent to the known tube stem is obtained with a 13 mil wall. 2) The bending/torsional strength and stiffness of the TZM stem are more than four times that of the known tube stem for a wall thickness greater than 13 mils. 3) Buckling of the shaft in torsion could be a concern for TZM stem walls less than 13 mils thick. 4) For the stem to provide the same thermal resistance as the known tube stem, a 13 mil wall is required while a 25 mil wall provides only half the thermal resistance of the known tube stem.

Calculations for a large bore, thin-walled stem made of niobium-alloy C103 have also been performed. As is known, C103 offers less strength and less stiffness than TZM. However, the increased thermal resistance that C103 offers appears to make its use appealing as an x-ray tube large bore, thin-walled tubular stem. In addition, the ductile nature of C103 allows it to be formed very easily, and allows for a variety of welding and other joining techniques.

Figure 6:
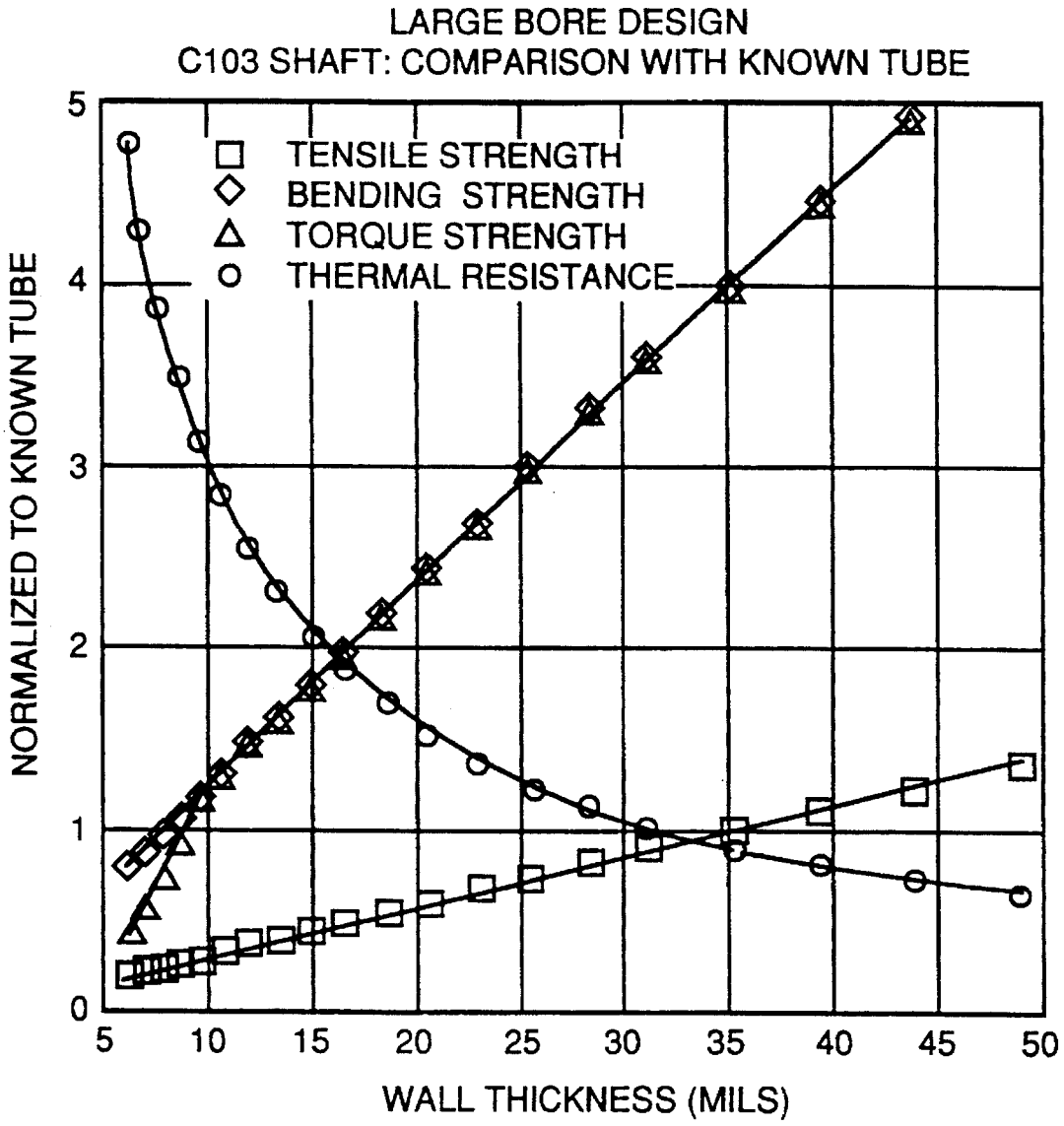
FIG. 6 is a graph illustrating calculations for a stem for a large bore tubular stem anode of C103 with various wall thicknesses.

FIG. 6 illustrates calculations for a C103 large bore, thin-walled stem having various wall thicknesses. All results were normalized against similar calculations for the known tube stem made with TZM. As can be seen, the large-bore stem provides much more strength/stiffness in bending and torsion than the known tube stem. Although the bending and torsional strength of the C103 large bore, thin-walled stem is not as large as the TZM large bore, thin-walled stem, the geometric advantage of the large bore, thin-walled stem design provides much more strength than the known tube stem. At about 33 mils, the large bore, thin-walled stem is expected to offer the same thermal resistance and tensile strength as the known tube stem.

In summary, the calculations have shown that for a C103 large bore thin-walled stem: 1) A stem tensile strength equivalent to the known tube stem is obtained with a 35 mil wall. 2) The bending/torsional strength and stiffness is more than twice that of the known tube stem for a wall thickness greater than 17 mils. 3) Buckling of the stem in torsion could be a concern for walls less than 13 mils.

Presently, a comparison of TZM and C103 as material for a large bore, thin-walled, tube stem indicates that TZM provides about 2.7 times the strength and stiffness of C103 at 1100° C. C103 provides about 2.4 times the thermal resistance of TZM at 1100° C. The large bore, thin-walled, tube stem design provides sufficient strength/stiffness in bending and torsion for either stem material selected. The thinness of the stem wall is limited by manufacturing practicality and the susceptibility of the stem to buckling. For a design that is as strong, stiff and thermal resistive as the known tube stem, a TZM stem would be about 13 mils thick; a C103 stem would be about 30 mils thick. The ductility of the C103 provides additional advantages. Standard welding techniques can be used in target and rotor attachment. If mechanical fasteners are selected, cracking under the bolt heads can occur with TZM; C103 will have no problem with cracking. It is easier and less expensive to manufacture C103 tubes than TZM tubes.

Concerning the attachment of the target/stem assembly to the rotor body assembly, a flat bottom plate can be attached to the end of the stem which then attaches to the rotor body assembly to form the anode assembly. For ductile materials, this plate could be welded into place prior to the attachment of the stem into the target. This plate serves as support for mechanical fasteners.

As illustrated in FIG. 4, in one embodiment, a bottom plate 120, preferably made of C103 is preferably EB welded to the tubular stem 108. A plurality of holes, preferably four (4), are drilled in the bottom plate 120 for connecting the target/stem assembly to the rotor body assembly 124. The plate 120 may also be made of material such as Nb; CB-752 (Nb, 10 W, 2.5 Zr); C129Y (Nb, 10 W, 10 Hf, 0.1 Y) and; FS-85 (Nb, 28 Ta, 11 W, 0.8 Zr) as well as the preferred C103 (Nb, 10, Hf, 1Ti, 0.7Zr).

The rotor body assembly comprises at one end a bearing hub 126, preferably made of IN718, and a rotor hub 128 positioned between the bearing hub and the bottom plate 120. In a preferred embodiment, one or more thermal barrier washers 130, made of, for example, a ceramic having a low thermal conductivity such as partially-stabilized zirconia or a metal such as a refractory metal like C103 or a superalloy such as IN718, is inserted for limiting the amount of heat which is transferred from the target/stem assembly to the rotor body assembly. The thermal barrier washers 130 provide increased thermal resistance by introducing a highly thermal resistive material into the anode assembly such as , for example zirconia and by providing additional thermal contact resistance at the contact surface between the mating parts, such as, for example, between the bottom plate 120 and the thermal washer(s) 130. The thermal barrier washers 130 may also be made of material such as Nb; CB-752 (Nb, 10 W, 2.5 Zr): C129Y (Nb, 10W, 10 Hf, 0.1 Y); FS-85 (Nb, 28 Ta, 11 W, 0.8 Zr); and C103 (Nb, 10, Hf, 1 Ti, 0.7 Zr).

To operatively connect the rotor body assembly with the target/stem assembly, a plurality of fasteners, for example, threaded fasteners, preferably made of IN718, TZM or an niobium alloy are passed through the bottom plate 120 through the thermal barrier washer 130 and the rotor hub 128 into threaded portions in the bearing hub 126. These preferably threaded fasteners are then torqued to preferably about 20 in. lbs. to about 60 in. lbs.

As also illustrated in FIG. 4, the connection along seams 110 and 112 provides for a unitary construction of target/tubular stem assembly 100 and a more stable connection to the rotor body assembly 124, which is more resistant to structural changes during the stressing caused by the above mentioned severe protocol uses. Since it has been determined that the anode assembly imbalance problems were, most likely, caused by changes that occur in the area of the target/stem assembly—rotor body assembly attachment, the illustrated construction is believed to at least reduce the relative changes in position between the stem and target and rotor thereby significantly reducing anode assembly imbalance failures.

Because of the large contact surface between the bottom plate and the rotor body assembly, multiple fasteners, preferably threaded, could be used. With multiple fasteners and the large contact surface (providing stability under bending and unbalance loading), the strength requirements for the fasteners will be less than in small-diameter stem designs.

Figure 7:
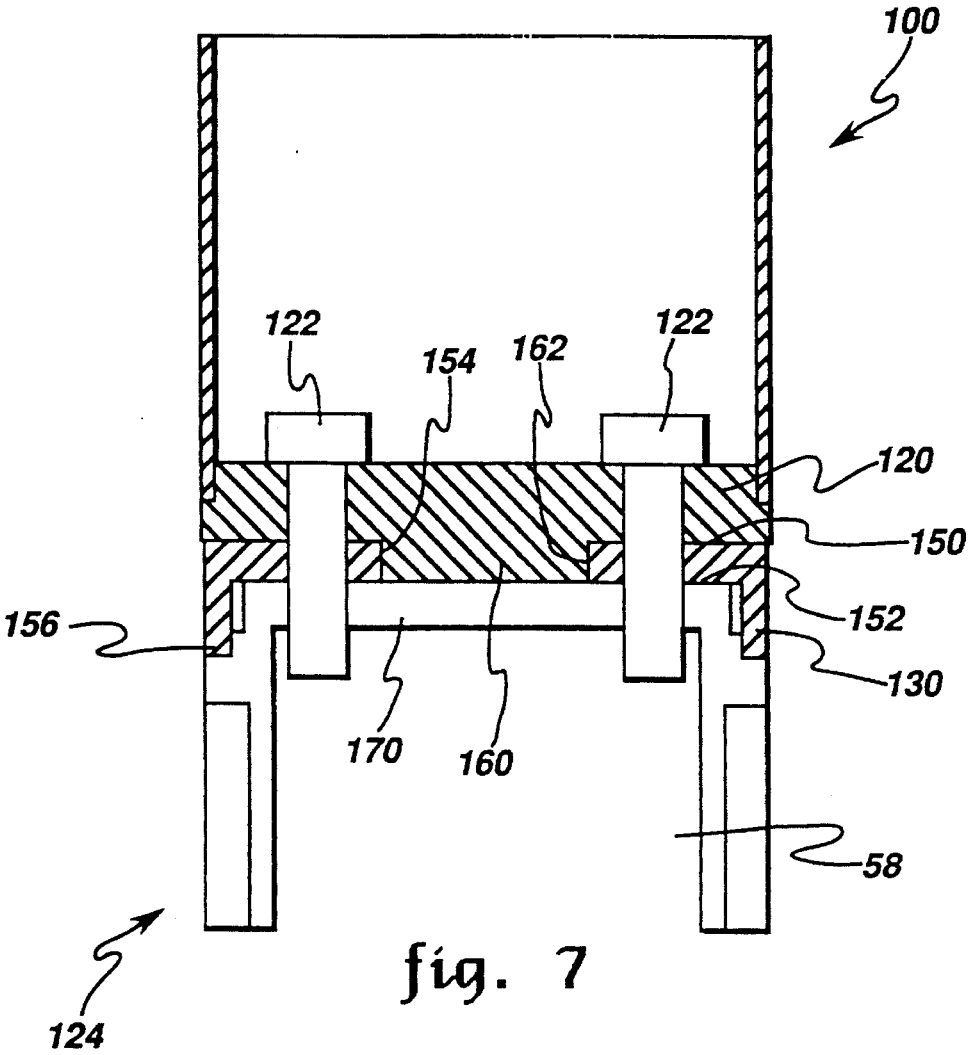
FIG. 7 is a partial sectional view of a target/stem-anode connection of the present invention.

The use of mechanical fasteners will most likely require the joining of dissimilar metals. Washers between the target/stem assembly and the rotor hub can be used to more closely match the thermal expansion of the fastener material. FIG. 7 illustrates a cross section of a representative anode assembly near the region of the target/stem assembly to rotor body connection of the present invention. It should be understood that there could be more than one set of fasteners 122 and not just the one set of fasteners as illustrated. Specifically, one set of fastener 122 could be bolted to a first and second washer and a second set of fasteners could be bolted to the bearing hub via the second washer. The second set of fasteners would be positioned in the bore of the first washer and offset with respect to the first set of fasteners, for example at about forty five (45) degrees with respect to the location of the first set of fasteners.

In order to maintain long term anode assembly balance, it is important that the alignment between the target/stem assembly 100 and the rotor body assembly 124 be accurate. One approach for achieving such an improved alignment is that the contacting surfaces 150, 152 perpendicular to the axis of the anode assembly are all machined, flat and parallel. Therefore, when the target/stem assembly 100 and the rotor body assembly 124 are assembled together, the top of the target 102 is parallel to all of the contacting surfaces (within specified tolerances, for example 0.001"). Additionally, the contacting surface parallel to the anode assembly axis (shown as surfaces 154 and 156 in FIG. 7) are machined to very tight tolerances, for example 0.0005". These surfaces assure the alignment and concentricity of the combination target/stem assembly and the rotor body assembly with respect to the target.

Any gaps between the parallel contacting surfaces (similar to surfaces 154 and 156 in FIG. 7) must be greater than zero to allow for the thermal washer 130 and the bottom plate cap 120 components to be assembled to the rotor at room temperature. In the past, these particular components, on which the parallel contacting surfaces were machined, were made from dissimilar metal alloys. The alloys used to make these components were selected such that the gap between the connected components increased at operating temperatures. Because significant gaps were present in operating temperatures, either welding or brazing was required to keep these components in contact when the x-ray tube was operating. When a braze was used, these expanding gaps created large strains within the brazed material.

Figure 8:
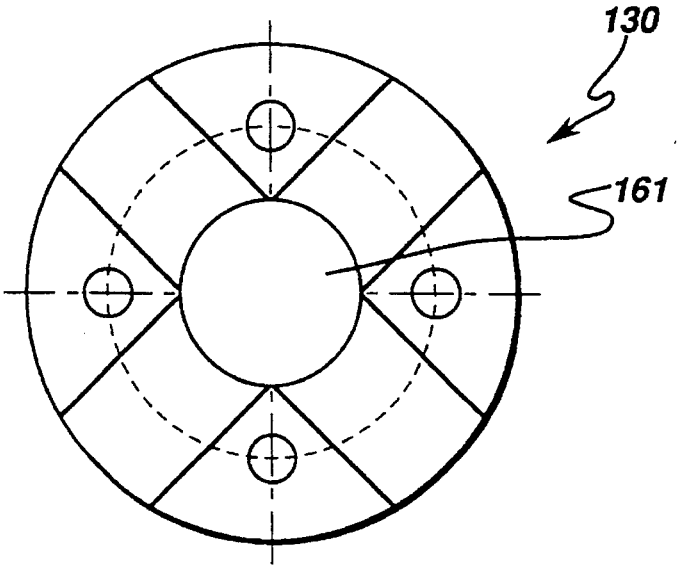
FIG. 8 is a plan view of a thermal washer usable with the present invention.

In one preferred embodiment of the present invention, the bottom plate 120 and thermal washer 130 (see FIG. 8) are made of a niobium alloy, such as C103. Thus, the bottom plate 120 and the thermal washer 130 have the same coefficient of thermal expansion. Since the bottom plate is closer to the x-ray tube target 102 and thus will see higher temperatures than the thermal washer 130 during tube operating conditions, the knob portion 160 of the bottom plate 120 will expand more than the aperture 161 formed in the thermal washer 130 into which the knob portion 160 fits. Thus, any gaps between the bottom plate and the thermal washer will actually close under operating conditions and compressive stresses will most likely be present at the bottom plate/thermal washer interface 162 during x-ray tube operations. If the initial distances between the adjacent surfaces of the bottom plate 120 and the thermal washer 130 can be designed such that no significant yielding, due to the compressive stresses, takes place, then a tight fit therebetween will be assured during the life of the x-ray tube.

In the x-ray system of the present invention, the thermal washer 130 is made from a niobium alloy, preferably C103. The top portion of the rotor 170 is made from IN718. IN718 has a significantly higher coefficient of thermal expansion than niobium alloys. Therefore, under normal x-ray tube operating conditions, the rotor bearing 172 will expand more in the radial direction than the thermal washer. The gaps between the thermal washer and the rotor bearing will close resulting in compressive stresses at their interface during operation. As with the interface between the bottom plate and thermal washer, if this expansion can be controlled so that no significant yielding, due to the compressive stresses, takes place, a tight fit will be assured during the entire life of the anode assembly of the x-ray tube.

As examples for the above thermal expansion coefficients, the mean thermal coefficient of expansion for niobium alloys is about $7\times10^{-6}$ to about $9\times10^{-6}$ per degree C. and the mean thermal coefficient of expansion for IN 718 is about $13\times10^{-6}$ to about $15\times10^{-6}$ per degree C.

The following characteristics of the washer(s) is important to proper anode balance: the washer(s) should be machined to high tolerances so that anode assembly balance is not significantly impaired by the introduction of one or more washers to the connection; the washer(s) should be designed (select materials having appropriate thermal expansion coefficients) so that the gaps between adjacent components close up rather than spread apart during operation; the washer(s) should be designed so that compressive stresses between adjacent components do not lead to significant yielding of the washer or the adjacent components during operation; and the washer(s) should be designed so that stresses within the washer do not lead to stresses above the strength of the washer(s) material, especially important when the washer(s) is made of a ceramic.

As will be understood by those skilled in the art, it is also important to ensure that the fastener material and geometry are selected such that a sufficient preload can be initially applied to the target/stem assembly and the rotor body assembly connection and maintained during tube operation. If the preload stresses are too high for the materials and geometry chosen, creep or plastic deformation of the fastener at elevated temperatures might sufficiently decrease the preload such that the fasteners could not function properly and the two assemblies could separate.

The use of mechanical fasteners 122 in conjunction with the present invention allows for easy disassembly of the target/stem assembly and the rotor body assembly. In the known tube stem assembly, the final target-rotor attachment is made by EB-welding. If significant unbalance results, rework is not possible. For a mechanically fastened design, rework or rebalance is possible.

The following appears to be the advantages of a large-bore, thin-walled stem design: allows the target-stem assembly 100 to be attached to the rotor body assembly 124 to form the anode assembly by mechanical fasteners; provides for a large surface contact between the rotor body assembly and the target/stem assembly and, thus, adds to the stability and strength of the target/stem assembly-rotor body assembly connection; fasteners are easily accessed through the top of the target via the hollow tubular stem; if necessary, the rotating anode assembly, which includes the rotor body assembly; and the target/stem assembly, can be disassembled for rework or rebalance during manufacture.

Thermal tests have demonstrated that the fastened target/stem assembly-rotor assembly of the present invention provides at least as much thermal resistance as known tube designs where the stem is attached to the target by either bolting or inertia welding.

While the articles contained herein constitute preferred embodiments of the invention, it is to be understood that the invention is not limited to these precise articles, and that changes may be made therein without departing from the scope of the invention which is defined in the appended claims.

What is claimed is:

1. An x-ray tube comprising:

a glass envelope;

a cathode assembly, operatively positioned in the glass envelope;

an anode assembly including:

a rotor body assembly including a rotor and a stator, the stator being operatively positioned relative to the rotor body assembly; and a target, operatively positioned relative to the cathode assembly, operatively connected to a tubular stem to form a target/stem assembly; and a plate operatively positioned between the tubular stem and the rotor body assembly and a thermal washer operatively positioned between the plate and the rotor body assembly, for operatively connecting the target/stem assembly to the rotor body assembly.

2. The x-ray tube of claim 1, wherein the tubular stem comprises C-103.

3. The x-ray tube of claim 1, wherein the plate comprises a material chosen from the group comprising:

Nb; CB-752 (Nb,10 W,2.5 Zr); C129Y (Nb,10 W,10 Hf,0.1 Y); FS-85 (Nb,28 Ta, 11 W, 0.8 Zr); and C103 (Nb, 10, Hf, 1 Ti, 0.7 Zr).

4. The x-ray tube of claim 1, wherein the plate comprises a niobium alloy.

5. The x-ray tube of claim 1, wherein the thermal washer comprises a ceramic having a low thermal conductivity.

6. The x-ray tube of claim 1, wherein the thermal washer comprises a niobium alloy.

7. The x-ray tube of claim 1, wherein the thermal washer comprises a material chosen from the group comprising:

Nb; CB-752 (Nb,10 W,2.5 Zr); C129Y (Nb,10 W,10 Hf,0.1Y); FS-85 (Nb,28 Ta,11 W, 0.8 Zr); and C103 (Nb,10,Hf,1 Ti,0.7 Zr).

8. An anode assembly for an x-ray tube comprising:

a rotor body assembly including a rotor and a stator, the stator being operatively positioned relative to the rotor body assembly; and a target, operatively positioned relative to the cathode assembly, operatively connected to a large bore, thin-walled tubular stem to form a target/stem assembly, and means, including a thermal washer operatively positioned between a plate and the rotor, operatively positioned between the target/stem assembly and the rotor body assembly, for operatively connecting the target/stem assembly to the rotor body assembly.

9. The anode assembly of claim 8, wherein the plate is operatively positioned between the tubular stem and the rotor body assembly.

10. The anode assembly of claim 8, wherein the thermal washer comprises a material chosen from the group comprising:

Nb; CB-752 (Nb,10 W,2.5 Zr); C129Y (Nb, 10 W, 10 Hf, 0.1 Y); FS-85 (Nb, 28 Ta, 11 W, 0.8 Zr); and C103 (Nb,10,Hf, 1 Ti, 0.7 Zr).

11. An x-ray system comprising;

an enclosure having oil contained therein;

an oil pump, operatively positioned relative to the enclosure for circulating oil within the system;

at least one cooling means, operatively connected to the enclosure and the oil pump, for cooling the oil;

an x-ray tube, operatively positioned inside the enclosure, for generating and directing x-rays toward a target, the x-ray tube comprising:

a glass envelope;

a cathode, operatively positioned in the glass envelope;

an anode assembly including:

a rotor body assembly including a rotor and a stator, the stator being operatively positioned relative to the rotor body assembly; and a target, operatively positioned relative to the cathode assembly, operatively connected to a tubular stem to form a target/stem assembly, and means, including a thermal washer operatively positioned between a plate and the rotor, operatively positioned between the target/stem assembly and the rotor body assembly, for operatively connecting the target/stem assembly to the rotor body assembly.

12. The x-ray system of claim 11, wherein the plate is operatively positioned between the tubular stem and the rotor body assembly.

13. The x-ray system of claim 12, wherein the plate comprises a material chosen from the group comprising:

Nb; CB-752 (Nb, 10 W, 2.5 Zr); C129Y (Nb, 10 W, 10 Hf, 0.1 Y); FS-85 (Nb, 28 Ta, 11 W, 0.8 Zr); and C103 (Nb, 10, Hf, 1 Ti, 0.7 Zr).

14. The x-ray system of claim 12, wherein the plate comprises a niobium alloy.

15. The x-ray tube of claim 11 wherein the thermal washer comprises a niobium alloy.

16. An anode assembly for an x-ray tube comprising:

a rotor body assembly including a rotor and a stator, the stator being operatively positioned relative to the rotor body assembly; and a target, operatively positioned relative to the cathode assembly, operatively connected to a large bore, thin-walled tubular stem to form a target/stem assembly, and structure, operatively positioned between the target/stem assembly and the rotor body assembly, for operatively connecting the target/stem assembly to the rotor body assembly, wherein the target/stem assembly to the rotor body assembly connection structure further comprises:

a plate operatively positioned between the large bore, thin-walled tubular stem and the rotor body assembly; and a thermal washer operatively positioned between the plate and the rotor body assembly.

17. The anode assembly of claim 16, wherein the thermal washer comprises a material chosen from the group comprising:

Nb; CB-752 (Nb, 10 W, 2.5 Zr); C129Y (Nb, 10 W, 10 Hf, 0.1Y); FS-85 (Nb, 28Ta, 11W, 0.8 Zr); and C103 (Nb, 10, Hf, 1 Ti, 0.7 Zr).

18. An x-ray tube comprising:

an envelope;

a cathode assembly, operatively positioned in the envelope;

an anode assembly including:

a rotor body assembly including a rotor and a stator, the stator being operatively positioned relative to the rotor body assembly; and a target, operatively positioned relative to the cathode assembly, operatively connected to a large bore, thin-walled tubular stem to form a target/stem assembly, and structure, including washer means, operatively positioned between the target/stem assembly and the rotor body assembly, for operatively connecting the target/stem assembly to the rotor body assembly.

19. The x-ray tube of claim 18, wherein the target/stem assembly to the rotor body assembly connection structure further comprises:

a plate operatively positioned between the tubular stem and the rotor body assembly.

20. The x-ray tube of claim 19, wherein the plate comprises a material chosen from the group comprising:

Nb; CB-752 (Nb,10 W,2.5 Zr); C129Y (Nb,10 W,10 Hf,0.1Y); FS-85 (Nb,28 Ta,11 W, 0.8 Zr); and C103 (Nb,10,Hf,1 Ti,0.7 Zr).

21. The x-ray tube of claim 19, wherein the plate comprises a niobium alloy.

22. The x-ray tube of claim 18, wherein the washer means further comprises:

a thermal washer operatively positioned between a plate and the rotor body assembly.

23. The x-ray tube of claim 22, wherein the thermal washer comprises a niobium alloy.

24. The x-ray tube of claim 22, wherein the thermal washer comprises a material chosen from the group comprising:

Nb; CB-752 (Nb, 10 W, 2.5 Zr); C129Y (Nb, 10 W, 10 Hf, 0.1 Y); FS-85 (Nb, 28 Ta, 11 W, 0.8 Zr).; and C103 (Nb, 10, Hf, 1 Ti, 0.7 Zr).

25. The x-ray tube of claim 22, wherein the thermal washer comprises a ceramic having a low thermal conductivity.

26. The x-ray tube of claim 18, wherein the tubular stem comprises C-103.

27. An x-ray system comprising;

an enclosure;

at least one cooling means, operatively connected to the enclosure, for cooling the system;

an x-ray tube, operatively positioned inside the enclosure, for directing x-rays toward a target, the x-ray tube comprising:

an envelope;

a cathode, operatively positioned in the envelope;

an anode assembly including:

a rotor body assembly including a rotor and a stator, the stator being operatively positioned relative to the rotor body assembly;

a target, operatively positioned relative to the cathode assembly, operatively connected to a large bore, thin-walled tubular stem to form a target/stem assembly; and structure, including washer means, operatively positioned between the target/stem assembly and the rotor body assembly, for operatively connecting the target/stem assembly to the rotor body assembly.

28. The x-ray system of claim 27, wherein the target/stem assembly to the rotor body assembly connection structure further comprises:

a plate operatively positioned between the large bore, thin-walled tubular stem and the rotor body assembly.

29. The x-ray system of claim 28, wherein the plate comprises a material chosen from the group comprising:

Nb; CB-752 (Nb, 10 W,2.5 Zr); C129Y (Nb,10 W,10 Hf,0.1 Y); FS-85 (Nb,28 Ta,11 W,0.8Zr); and C103 (Nb,10,Hf,1 Ti,0.7 Zr).

30. The x-ray system of claim 28, wherein the plate comprises a niobium alloy.

31. The x-ray tube of claim 27, wherein the washer means further comprises:

a thermal washer operatively positioned between a plate and the rotor.

32. The x-ray tube of claim 31 wherein the thermal washer comprises a niobium alloy.

* * * * *